United States Patent [19]

Barry

[11] 4,165,544

[45] Aug. 28, 1979

[54] ODORLESS TOILET STOOL

[76] Inventor: Bill H. Barry, P.O. Box 607, Bartlesville, Okla. 74003

[21] Appl. No.: 905,727

[22] Filed: May 15, 1978

[51] Int. Cl.[2] ..... E03D 9/04; E03D 9/05

[52] U.S. Cl. ..... 4/213; 4/216; 4/218

[58] Field of Search ..... 4/213, 216, 217, 218

[56] References Cited

U.S. PATENT DOCUMENTS

| | | | |
|---|---|---|---|
| 2,100,962 | 11/1937 | Juntunen | 4/213 |
| 2,134,629 | 10/1938 | Walsh et al. | 4/213 |
| 2,279,789 | 4/1942 | Jentzar | 4/213 |
| 2,575,778 | 11/1951 | Wilson | 4/213 |
| 3,102,275 | 9/1963 | Raymond | 4/213 |
| 3,122,757 | 3/1964 | Sowards | 4/213 |
| 3,192,539 | 7/1965 | Martz | 4/213 X |
| 3,626,554 | 12/1971 | Martz | 4/213 |
| 3,691,568 | 9/1972 | Martz | 4/213 |
| 3,900,908 | 8/1975 | Stump | 4/213 |
| 4,031,574 | 6/1977 | Werner | 4/213 |

*Primary Examiner*—Henry K. Artis

*Attorney, Agent, or Firm*—Head, Johnson & Chafin

[57] ABSTRACT

A system for eliminating odorous air from a bathroom stool of the type including a toilet bowl, a water tank connected by a discharge pipe to the toilet bowl, the water tank including a vertical open top overflow passageway connected to the discharge pipe so that water in excess of the desired level in the tank is dispensed into the toilet bowl and through which odorous air may be withdrawn from the toilet bowl, including a hollow open bottom vertical member positioned over the upper end of the overflow pipe, the sleeve lower end terminating below the normal water level in the water tank whereby a water seal is provided so that closed communication is established between the overflow passage and the sleeve, and an air pump having connection to the sleeve to move air from the stool through the overflow pipe and sleeve for remote exhaust.

2 Claims, 6 Drawing Figures

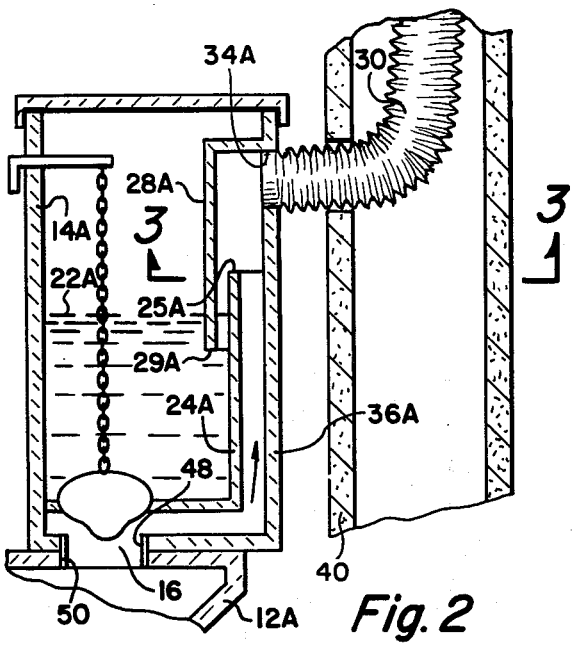
Fig. 2
Fig. 3
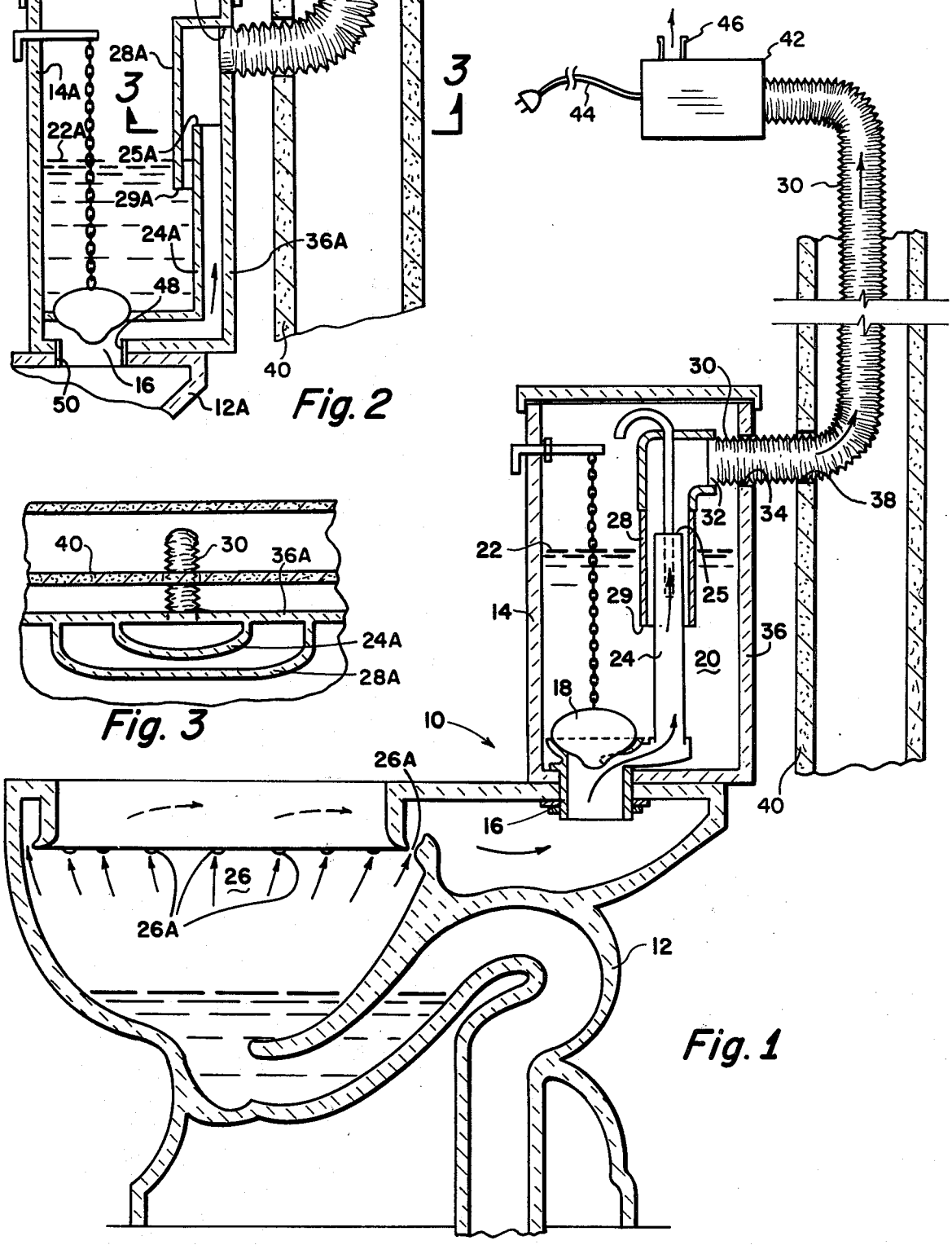
Fig. 1

ODORLESS TOILET STOOL

BACKGROUND AND OBJECTS OF THE INVENTION

Others have provided devices for eliminating the odorous air from a bathroom stool. It is a recognized problem, particularly in hospitals, nursing homes, but also to a lesser extent in office buildings, private homes, etc. A difficulty with the existing systems is that most are relatively complex and expensive or require extensive modification of existing toilet facilities.

The present invention is directed towards a system for eliminating odorous air from a bathroom stool wherein the minimum modification of existing type of bathroom stools is required.

It is therefore an object of this invention to provide an improved, simplified, and economical means of providing a system for eliminating odorous air from a bathroom stool.

More particularly, an object of this invention is to provide a system for eliminating odorous air from a bathroom stool of the type which includes a toilet bowl in which a reservoir of water is retained and a vertical overflow passageway within the toilet bowl providing a means of discharging water in excess of the desired level in the tank, the lower end of the discharge pipe being in communication with the toilet bowl, the invention including a hollow open bottom vertical member positioned over the upper end of the overflow pipe, the lower end of the member extending below the normal water level in the tank providing a water seal so that closed communication is provided with the pipe and thereby with the toilet bowl. A means of exhausting the air from the vertical member is provided, thereby achieving an inexpensive and effective manner of adapting the system of this invention to commonly used bathroom facilities.

Another object of this invention is to provide a means of inducing a vacuum to move air out of a bathroom stool by circulation of water in the toilet bowl, the water serving not only to produce a vacuum to cause air movement but providing a scrubbing action whereby odors are removed from the air.

Still another object of this invention is to provide a means of applying vacuum to an institutional type toilet stool wherein water from a flush valve is introduced directly into the stool, including a water actuated check valve which prevents water from being inadvertently drawn into the vacuum system.

These general objects as well as other and more specific objects of the invention are achieved in the apparatus set forth in the following description and claims, taken in conjunction with the attached drawings.

DESCRIPTION OF THE VIEWS

FIG. 1 is an elevational cross-sectional view of a typical bathroom stool including a water tank and showing one means whereby a vacuum system may be attached to the stool for removing odors therefrom.

FIG. 2 is a partial elevational cross-sectional view of a different type of water tank used with bathroom stools wherein the overflow passageway is integrally built into the tank.

FIG. 3 is a partial cross-sectional view taken along the line 3—3 of FIG. 2.

SUMMARY OF THE INVENTION

Figure 5:
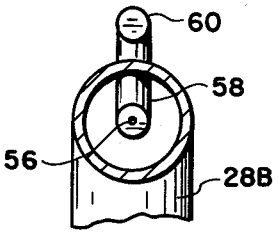
FIG. 5 is a partial cross-sectional view taken along the line 5—5 of FIG. 4 showing the arrangement of the jet system to produce movement of air and scrubbing action.

A system is provided for eliminating odorous air from a bathroom stool. The typical bathroom stool, particularly the type used in homes, includes a toilet bowl and a water tank connected by discharge pipe to the toilet bowl. The water tank includes a vertical open top overflow passageway connected to the discharge pipe so that water in excess of the desired level in the tank is dispensed into the toilet bowl. This vertical passageway is in communication with the toilet bowl. By means of this invention, a hollow open bottom vertical sleeve is positioned over the upper end of the overflow passageway. The lower end of the sleeve terminates below the normal water level in the tank so that a water seal is achieved providing closed communication between the overflow passageway and the sleeve. Means of creating low air pressure is connected to the sleeve so that odorous air is drawn from the stool through the overflow passageway.

In one embodiment a pump circulates water from the tank in a jet arrangement including air flow. The jet action simultaneously scrubs the air which is exhausted from the stool to remove odors therefrom. In another arrangement, an institutional type toilet stool which is actuated by water directly from a flush valve is provided with a "T" fitting between the flush valve and the stool and vacuum is applied to the "T" fitting so that odorous air is removed from the stool. To prevent inadvertent flow of water into the vacuum system, a water actuated valve is installed.

DETAILED DESCRIPTION OF THE PREFERRED EMBODIMENT

Referring to the drawings now, and first to FIG. 1, a bathroom stool is indicated generally by the numeral 10. The stool includes a toilet bowl 12 and a water tank 14. A discharge pipe 16 connects the water tank 14 to the stool. A plunger 18 within tank 12 normally closes the upper end of discharge pipe 16 so that water 20 is permitted to accumulate in the tank to a normal level 22.

Connected to the discharge pipe 16 is a vertical overflow passageway 24. In most stool configurations the overflow passageway 24 is in the form of a pipe as illustrated in FIG. 1. FIG. 2 illustrates a different arrangement of the overflow passageway which will be discussed subsequently.

The description of FIG. 1 up to this point is of the standard type bathroom stool as used in offices, homes, etc. It will be noted that there is communication between the interior 26 of toilet bowl 12, through discharge pipe 16, with overflow passageway 24. This open communication permits free passage of air from the interior of the toilet bowl through the flush holes 26A and ultimately out the top 25 of the overflow passageway 24. This invention is to a method of utilizing this already provided passageway to exhaust air from the stool interior 26. The invention includes a hollow open bottom vertical member or sleeve 28 which is positioned over the upper end of the overflow passageway 24. The bottom 29 of the vertical member 28 is below the normal water level 22 so that a water seal is provided between the vertical member 28 and overflow passageway 24.

Connected to the upper end of the vertical member 28 is a hose 30. To facilitate this connection, the illustrated arrangement includes the vertical member 28 being in an L-shaped configuration providing an outlet opening 32 at which the hose 30 is connected. The hose 30 extends through an opening 34 in the rear wall 36 of water tank 14. It can be seen that rather than opening 34, a notch may merely be cut in the upper end of wall 36. The size and shape of the opening is irrelevant as long as the opening is above the upper end 24A of overflow passageway 24 since the water level in the tank 14 cannot rise appreciably above this level. Hose 30 is shown extending rearwardly from tank 14 through an opening 38 in a wall 40 and up the interior of the wall to a remote located air pump 42. The air pump is typically electrically connected by power supplied by cord 44 and when actuated, pumps air up through the hose 30 in the direction indicated by the arrow and out the pump discharge 46. Hose 30 may be in the form of a pipe.

With air pump 42 actuated, air is moved as indicated by the arrow from the interior 26 of toilet bowl 12, out through the vertical member 28 which, when the overflow passageway 24 is in the form of a pipe as in FIG. 1, may be in the form of a sleeve, and up through hose 30 for remote discharge. If only a single bathroom stool 10 is to be serviced by air pump 42, then a switch may be provided (not shown) adjacent the stool so that it may be turned on as needed. However, in a facility having a multiplicity of bathroom stools, such as a motel, hotel, hospital, nursing home, office building, etc., a single vacuum pump 42 may be connected to all of the bathroom stools and constantly energized to provide a constant flow of air. Only a small amount of air movement is required to remove odorous air and prevent it from being otherwise spread throughout a building.

FIGS. 2 and 3 show the arrangement of the invention wherein a water tank 14A has a built-in overflow passageway 24A. Usually the water tanks 14 are made of ceramic, and in the arrangement of FIG. 2, the overflow passageway 24 is typically also made of ceramic, as illustrated in a cross-sectional view of FIG. 3. The overflow passageway is formed in part by the tank rear wall 36A. The passageway 24A communicates through discharge pipe 26 to the interior of the stool (not shown) to provide passageway for movement of air. The discharge pipe 16 may merely be in the form of a gasket fit between an opening 48 in the bottom of tank 14A and a corresponding opening 50 in the stool.

In the arrangement of FIGS. 2 and 3, the vertical member 28A is in the form of a means to enclose the upper open end 25A of the overflow passageway 24A. The vertical member 28A may be integrally formed with the tank 14A so that a portion of the vertical member is formed by the tank rear wall 36A as shown in FIG. 3. The lower end 29A of vertical member is below the normal water level 22A providing an air seal. Opening 34A receives the hose 30 and is conducted to a remote air pump or vacuum source in the same manner as described with reference to FIG. 1.

Rather than being integrally affixed to the interior of the tank 36A, the vertical member 28A may be preformed and secured to the interior of the tank such as by bonding cement.

Figure 4:
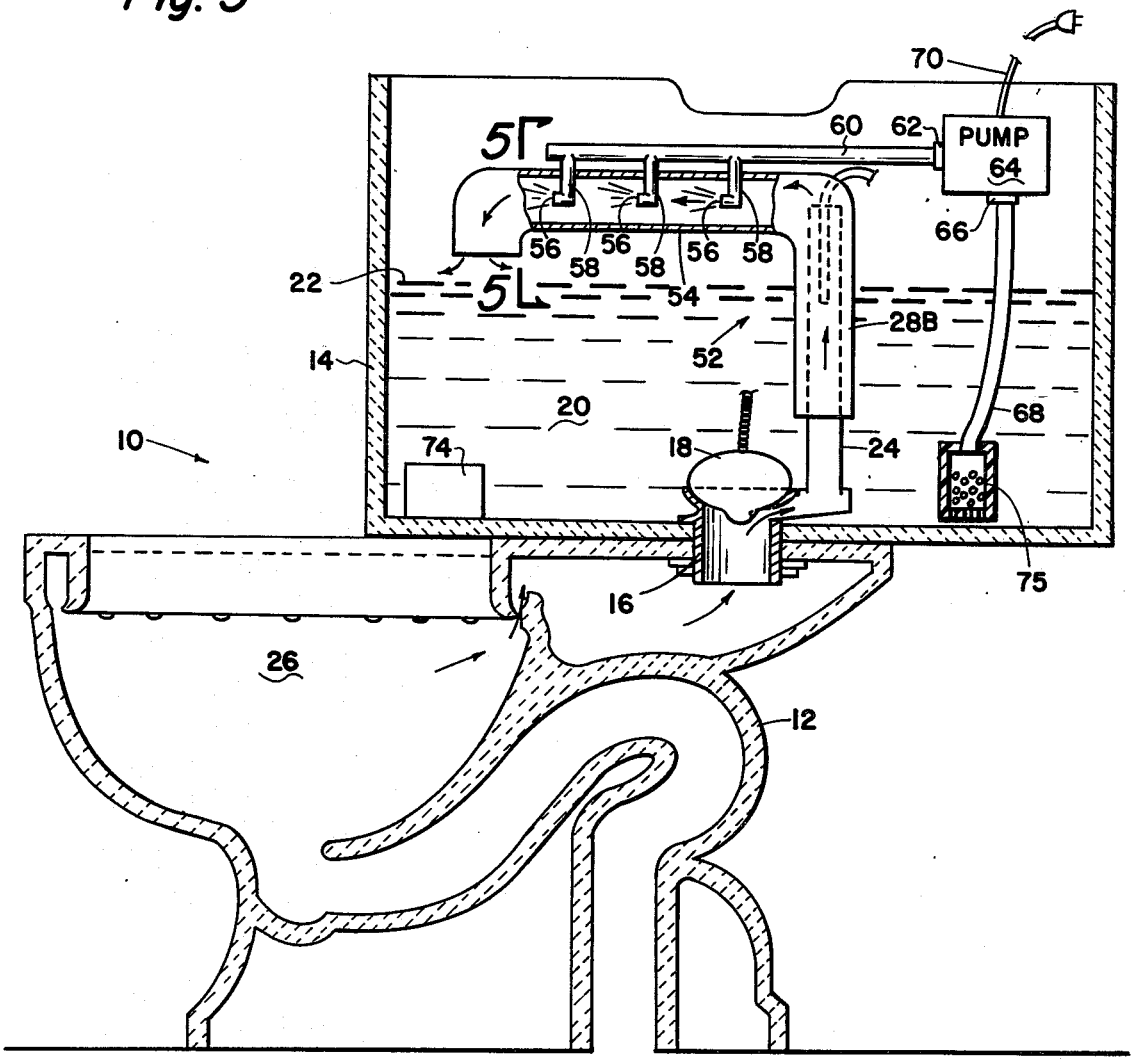
FIG. 4 is an elevational cross-sectional view of a bathroom stool having a tank and including a system wherein water from within the tank is circulated in an arrangement to induce a vacuum to move air out of the toilet stool and simultaneously to scrub the air to move odor therefrom.

FIGS. 4 and 5 show an alternate embodiment of the invention. This figure shows the use of a water tank 14 as in FIG. 1, however, for purposes of illustration, the water tank is rotated 90° relative to stool 12. In the arrangement of FIG. 4, a manifold 52 is utilized which includes a vertical portion 28B forming the vertical member previously described and a horizontal portion 54 which is integrally connected with the vertical portion 28B. The vertical portion extends down over the open upper end of the overflow passageway 24 forming a water seal as described with reference to FIG. 1. The manifold horizontal portion 54 extends within the interior of tank 14 above the normal water level 22. Positioned within the interior of the manifold horizontal portion 54 is a plurality of jets 56, three being shown. Each of the jets 56 is connected by a small pipe 58 to a common pipe 60 which in turn is connected to the outlet 62 of an electrically actuated water pump 64. The intake 66 of pump 64 is connected by a tube 68 to water 20 within the tank. A conductor 70 connected to the pump 64 provides means for energizing it.

When pump 64 is actuated, water is drawn through tube 68 and forced out pipe 60 and discharged through jets 56. The jet discharge in the manifold horizontal portion 54 causes movement of air out the manifold. Manifold 54 is provided with an L-shaped configuration 72 at the outer end so that air passing out from the manifold is directed downwardly towards water 20. Movement of air by water emanating from jets 56 exhausts air from the interior 26 of the bowl 12 and discharges it within the interior of the tank 14 as indicated by the arrows. In addition to movement of the air, water from jets 56 causes a scrubbing action of the air and collects all or at least a substantial portion of the odor which is otherwise entrained in the air. The odor extracted from the air is carried with the water and deposited into the tank 20. To increase the effectivenes of the scrubbing action of the water discharged by jets 56, a slow release chemical element 74 may be placed in water 20 in the tank. Chemicals released by elements 74 may be of the type commonly used in tanks of bathroom stools to improve the cleansing action of water flowing into the bowl and act as a germicidal agent. As an alternative, a canister 75 may be placed on the lower end of tube 68. The canister has a hole permitting water to flow in and may include crystals for releasing odor-absorbing chemicals and may also include a filter media.

Normally pump 64 will be energized only when necessary to remove odors from the bathroom stool, and for this reason, a switch (not shown) in conductor 70 may be conveniently located adjacent the stool.

In both FIGS. 1, 2, and 4, the means whereby water is introduced into the tank is not shown, nor the float arrangement for terminating the flow of water when it reaches its preselected level 22, since these are well-known components of a toilet stool and not part of this invention.

Figure 6:
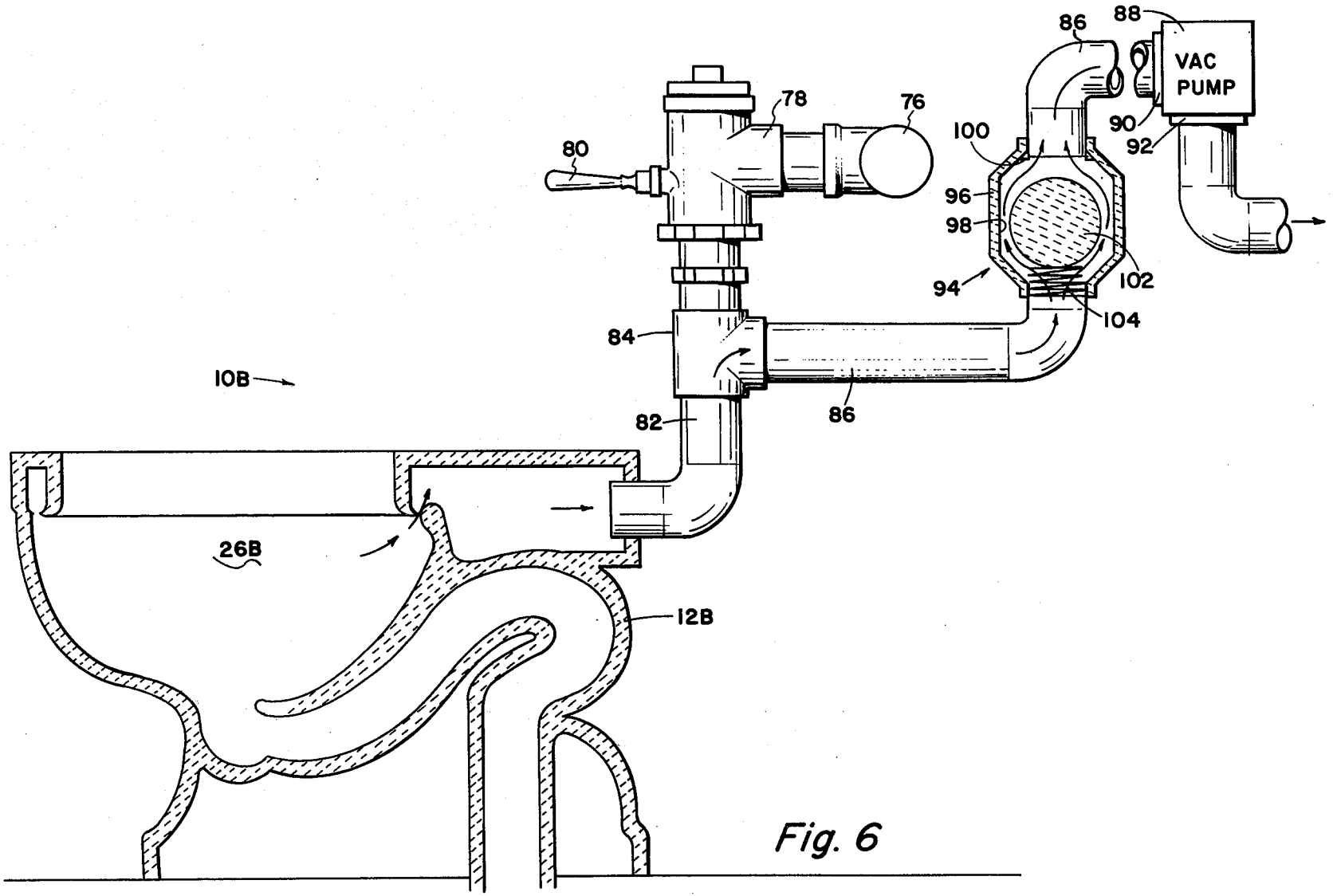
FIG. 6 is an elevational cross-sectional view of an institutional type stool arrangement including means for applying a vacuum to remove odorous air from the stool and including a water actuated check valve to prevent inadvertent admission of water into the vacuum system.

Referring to FIG. 6, another alternate embodiment of the invention is shown. This illustrates a type of bathroom stool which may be termed an institutional type, that is, most frequently employed in office buildings and sometimes in motels, hotels, hospitals, etc. In this type of facility the stool 12B does not include a water tank. A source of water from pipe 76 is supplied through a flush valve 78 having a handle 80. A pipe 82 connects the flush valve with the stool 12B. When handle 80 is actuated, a quantity of water is released which rushes into the stool to cause a flushing action, and the water flow is automatically terminated by valve 78.

To employ this invention, pipe 82 is equipped with a T fitting 84 providing a branch pipe 86. This pipe is connected to a remote vacuum pump 88 which supplies vacuum at the pump inlet 90 and discharges air at the outlet 92. The pipe 86 is connected to the pump inlet 90 so that when pump 88 is energized, air is caused to flow from the interior 26B of the bowl through pipe 82, T 84, and pipe 86 to be remotely discharged.

Water exists in T fitting 84 only during flushing of the toilet stool. To prevent flow of water upwardly through pipe 86, a water actuated check valve, generally indicated by numeral 94, is employed. The valve 94 includes a body 96 having a flow passageway 98 therethrough. A part of the flow passageway is defined by a valve seat 100 in the upper end of the valve body 96.

Positioned within the interior of body 96 and within the flow passageway 98 is a ball 102 which is larger in diameter than valve seat 100. Ball 102 is of a specific gravity heavier than air and lighter than water. The ball is supported in a central position by means of a spring 104 or other type element which freely permits the flow of air or water therepast, but prevents the ball from closing the valve 94 when in the downward position. It can be seen that air can freely flow within the flow passageway 98 around the periphery of ball 102.

When water enters pipe 86 and the interior of valve body 96, the water floats the ball 102 towards the top so that it seals against seat 100. Water is thereby prevented from flowing further in pipe 86 and is thereby prevented from entering air pump 88. In addition, the portion of the pipe 86 between the valve 94 and pump 88 is not required to sustain water pressure and would thereby be constructed of less expensive materials or may otherwise be arranged only to meet building code requirements for movement of air.

The arrangement of FIG. 6 is particularly useful for installation in large buildings where a centrally located air pump 88 may be utilized with a piping system to supply vacuum to all of the bathroom stools in the building. Pump 80A can then be continuously energized when the building is in use and since only relatively small quantities of air are required to remove the odorous air from a number of stools, a relatively small size air pump 88 can be employed to service a large number of bathrooms. In many buildings exhaust fans are provided for bathrooms wherein the entire bathroom is evacuated. By the principles of this invention, a much smaller quantity of air needs to be moved to remove odorous air from all of the bathrooms in a building.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A system for eliminating odorous air from a bathroom stool of the type including a toilet bowl, a water tank connected by a discharge pipe to the toilet bowl, the water tank including a vertical, open top overflow passageway connected to the discharge pipe so that water in excess of the desired level in the tank is dispensed into the toilet bowl and through which odorous air may be withdrawn from the toilet bowl, the system comprising:

a hollow, open bottom vertical member positioned over the upper end of the overflow passageway, the sleeve lower end terminating below the normal water level in the water tank, whereby a water seal provides closed communication between the overflow passageway and the member;

means of creating low air pressure connected to the upper end whereby odorous air is drawn from the bowl through the overflow pipe and scrubbed, said means comprising;

a manifold having a hollow vertical sleeve portion of internal diameter greater than the external diameter of the overflow pipe and positioned to extend down over the overflow pipe upper end, the lower end terminating below the normal water level in the water tank whereby a water seal is provided between the overflow pipe and the manifold vertical portion, and the manifold having a horizontal portion integrally connected to the vertical portion of one end, the other end being open, the horizontal portion adapted to extend within the tank above the water surface;

an electrically actuated pump having an inlet and outlet;

a tube extending from the pump inlet into the water in the tank;

at least one jet positioned within said manifold horizontal portion and oriented towards the open end; and a tube connecting said pump outlet to said jet, whereby when said pump is energized water from the tank is passed through the jet inducing air flow in said manifold, causing air to be moved from the toilet bowl, the overflow pipe and manifold into the tank, the air being scrubbed by water within the manifold horizontal portion to substantially remove the odor therefrom.

2. A bathroom stool including a toilet bowl, a water tank connected by a discharge pipe to the toilet bowl, the water tank including a vertical, open top overflow passageway integrally formed with the tank, one wall of the tank forming one wall of the passageway;

a vertical member secured to the same wall of said tank and extended down over the upper end of the passageway and terminating at its lower end below the normal water level, said wall of the tank forming one wall of said vertical member, the top of the vertical member being closed, said tank wall having an opening therein above said overflow passageway, communicating with said vertical member, and wherein means of creating low pressure includes a remote located air pump, and including a hose connecting said air pump to said opening.

* * * * *